US006155419A

United States Patent [19]

Sowa

[11] Patent Number: 6,155,419

[45] Date of Patent: Dec. 5, 2000

[54] APPLIANCE PACKAGE COVER

[75] Inventor: Paul E. Sowa, Wheeling, Ill.

[73] Assignee: Illinois Tool Works Inc., Glenview, Ill.

[21] Appl. No.: 09/239,657

[22] Filed: Jan. 29, 1999

[51] Int. Cl.[7] ..... B65D 85/00

[52] U.S. Cl. ..... 206/320; 229/122.27; 229/125.22

[58] Field of Search ..... 206/320, 453, 206/586, 597; 229/122.3, 122.27, 125.22; 220/DIG. 2

[56] References Cited

U.S. PATENT DOCUMENTS

| | | | |
|---|---|---|---|
| 2,887,263 | 5/1959 | Wright | 206/320 |
| 4,762,226 | 8/1988 | Gatton | 206/320 |
| 4,811,840 | 3/1989 | White . | |
| 5,131,541 | 7/1992 | Liebel . | |
| 5,289,969 | 3/1994 | Schwaner | 206/320 |
| 5,307,928 | 5/1994 | Bishop | 206/320 |

OTHER PUBLICATIONS

"Interlocking Double Cover Box—IC" brochure, 1 pg.
"The Basiloid Lift–A–Pliance" brochure, 1 pg.
T&D, "'Final Touch' in Packaging", Dec. 1987, pp. 38–39.
Packaging Digest, "The 'Wright' Way to File Away Distribution Savings", pp. 38, 40 and 41.

*Primary Examiner*—Linda Johnson
*Attorney, Agent, or Firm*—Donald J. Breh; Mark W. Croll; John P. O'Brien

[57] ABSTRACT

An appliance packaging assembly and method therefor, including a reinforced tray disposed under the appliance, a plurality of rigid posts disposed between the tray and alongside the appliance, a transparent film disposed about the posts and the appliance, a reinforced cover having a lifting flange member on a side portion thereof, the cover disposed over the plurality of wrapped posts and appliance, and tensioned strap disposed along side the posts and about the tray and cover and over the lifting flange member thereof.

19 Claims, 3 Drawing Sheets

APPLIANCE PACKAGE COVER

BACKGROUND OF THE INVENTION

The invention relates generally to packaging assemblies, and more particularly to transparent appliance packaging assemblies and methods therefor.

Presently, many appliances are packaged in full corrugated boxes after manufacture for shipping and handling. These appliances include among others refrigerators, freezers, laundry machines, ranges, dishwashers, water heaters, and vending machines. A commonly used full corrugated refrigerator package known as an Interlocking Flange Container (IFC), for example, comprises corrugated top and bottom caps interlockingly coupled to a corrugated tube by folding flaps, which are then secured by horizonal wire or strap disposed about the top and bottom caps.

Most manufacturers use interior packaging components including spacers and padding to varying degrees in connection with full corrugated packages to protect the appliance disposed therein, for example around the corners and handles thereof. Some industry shipping and packaging standards actually specify minimum dimensions for spacers between the container and appliance.

The IFC and other full corrugated packaging have many advantages including relatively quick assembly and high reliability. Many of these packages including the IFC packages may also be lifted and handled by a "Basiloid" spade or blade mounted on a lift truck. The Basiloid blade is a generally u-shaped member that may be hooked under the interlocking folded flaps of the top cap on a side portion of the container, and permits handling of the container without clamping or fork lifting. The Basiloid blade is used widely in the United States. In Europe however the Basiloid blade is not as well known, and most appliances are handled by clamp trucks, which grasp the container from opposing sides thereof.

Despite the advantages of IFC and other full corrugated packages discussed above, these packages prevent visual inspection of package contents without opening thereof. Visual inspection is highly desirable for product identification and assessment of damage that may occur during shipping. Full corrugated packages are also laborious to assemble, produce large amounts of waste, and are relatively costly.

More recently, transparent film type, or see-through, packaging has been proposed for appliances in an effort to reduce materials, labor and costs. U.S. Pat. No. 4,881,840 entitled "Appliance Shipping Container with Integral Corner Post", for example, discloses a partially corrugated container wrapped with a transparent film. The container comprises corrugated side panels with die-cut windows disposed on corresponding opposing sides of the appliance. The corrugated side panels also have overlapping folded cover portions that are retained over an upper portion of the appliance by a band of horizontal strap disposed thereabout.

Transparent appliance packaging has the advantage that its contents can be visually inspected more readily in comparison to full corrugated packages, although visibility in known transparent packages suitable for heavier appliances is obstructed to some degree, for example by the opposing side panels disclosed in U.S. Pat. No. 4,881,840 discussed above. The packaging process for transparent appliance packaging may also be automated thereby reducing labor costs, although the initial capital investment is generally high. Known transparent appliance packaging has not been accepted widely by industry for its inability to accommodate heavier packaging applications, and for its relatively unproven performance.

Another known transparent appliance package comprises a reinforced frame having angled fiberboard corner posts which are screwed to wooden battens fastened to a bottom portion of the appliance. The appliance and posts are then wrapped in a transparent stretch film. After wrapping, a corrugated tray and cover are disposed under and over the wrapped appliance and posts. A wooden batten is subsequently disposed across an outer side portion of the cover and screwed to two of the posts for handling by a Basiloid blade. Finally, a horizonal strap is disposed about the cover and the wooden batten thereof for additional strength.

The present invention is drawn toward advancements in the art of package assemblies, and more particularly to transparent packaging assemblies and methods therefor.

An object of the invention is to provide novel packaging assemblies and methods therefor that overcome problems in the art.

Another object of the invention is to provide novel packaging assemblies and methods therefor that are improved over the prior art by providing any one or more of the following advantages, including among others, greater economy, improved strength suitable for heavier appliances, improved packaging protection, quick and easy assembly, improved product visibility, easy opening, and reduced waste.

Still another object of the invention is to provide novel packaging assemblies that may be lifted and handled by a Basiloid blade.

A more particular object of the invention is to provide novel packaging assemblies and methods therefor useable for appliances comprising generally a reinforced tray disposable under an appliance to be packaged, a plurality of posts disposable between the tray and alongside the appliance, a transparent film disposable about at least the posts and the appliance, a reinforced cover having a lifting flange member disposed over the plurality of wrapped posts and appliance, and strap disposed about the tray and cover and over the lifting flange member thereof.

Another more particular object of the invention is to provide novel packaging assemblies and methods therefor useable for appliances comprising generally a corrugated paperboard cover having folded side portions, and a lifting flange member disposed across an outer portion of one of the cover side portions. The lifting flange member having a reinforcing member extending from an inner portion of the cover. The lifting flange member is disposed across the outer portion of the corresponding side portion, and a portion of the cover is folded over the reinforcing member.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
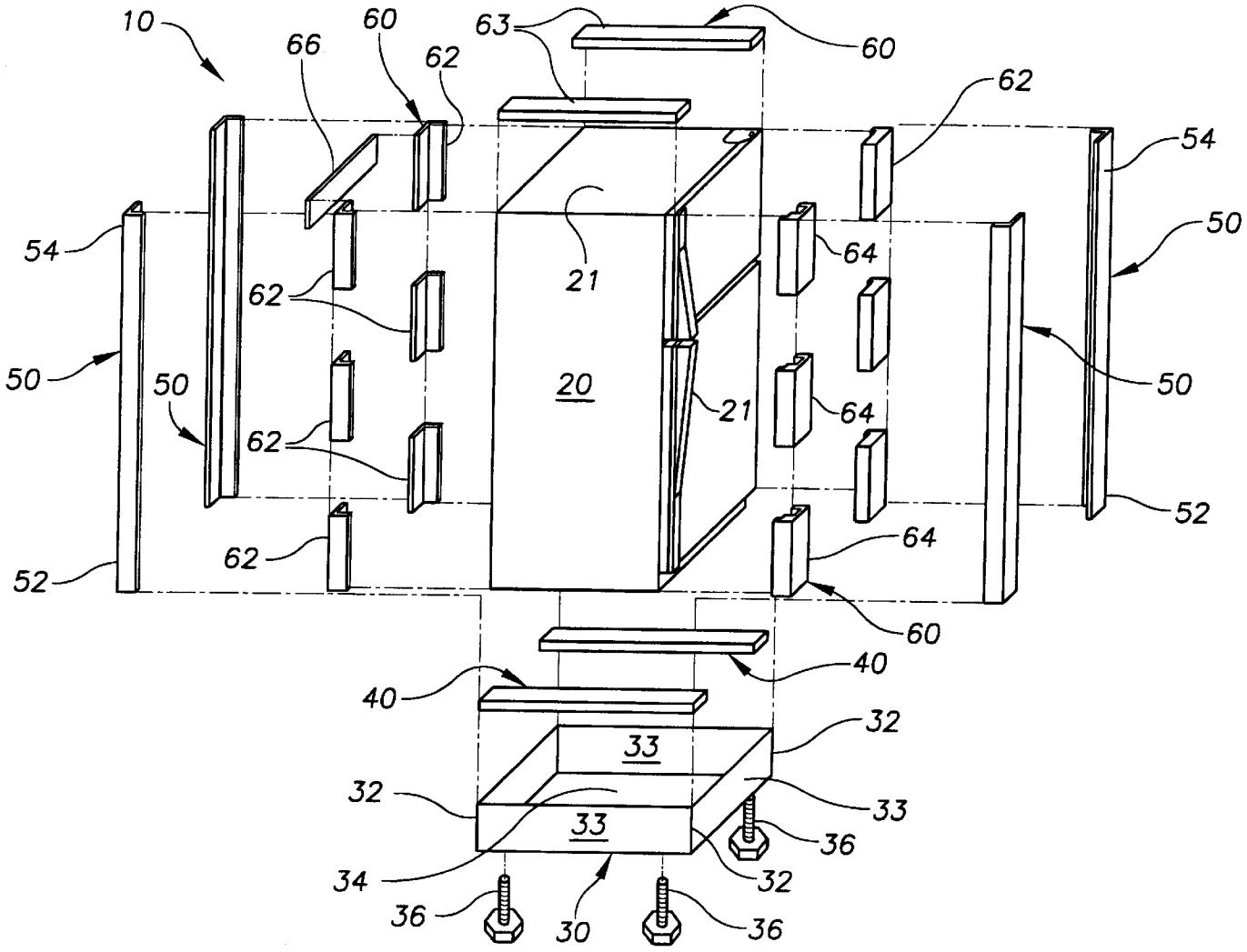
FIG. 1 is a partial diagrammatic view of a packaging assembly according to an exemplary embodiment of the invention.

FIG. 1 is a partial exploded view of a packaging assembly 10 useable for packaging an appliance 20, which in the exemplary embodiment is a refrigerator. More generally, however, the packaging assembly 10 and the packaging methods of the present invention are suitable for packaging most any appliance, especially heavier appliances, including among others freezers, laundry machines, ranges, dishwashers, water heaters, and vending machines. The packaging assembly of the present invention may also be used for packaging other articles besides appliances.

The packaging assembly 10 comprises generally a tray 30 having side portions 33 disposable under the appliance 20 to be packaged. The side portions 33 of the tray are sufficiently high to support posts 50 during assembly of the package 10 as discussed further below and preferably have a relatively low profile to avoid unnecessary visual obstruction of the packaged appliance. In the exemplary embodiment, the tray 30 is generally rectangular shaped and has a plurality of corners 32 defined by the side portions 33 thereof.

The tray 30 is formed preferably of a relatively low cost material, for example a corrugated paperboard material, although other non-corrugated and non-paperboard materials may be used alternatively. In the exemplary embodiment, the tray 30 and particularly the side portions 33 thereof are formed by folding a sheet of corrugated paperboard stock and fastening flap portions thereof with an adhesive or staples or interlocking flanges or other known means, including combinations thereof.

The tray 30 is preferably reinforced with one or more reinforcing members. In FIG. 1, two battens 40, for example 1×4 wood runners, are disposed on an inner portion 34 of the tray 30 in spaced apart relation so that the battens 40 are located between the appliance 20 and the tray 30. In one embodiment, each batten 40 is fastened to an underside portion of the appliance 20, for example by two bolts 36 screwed into corresponding threaded openings of the appliance. The tray 30 is preferably fastened to the battens 40 with the same bolts 36 that fasten the battens 40 to the appliance 20. The tray 30 may, however, be fastened to the battens 40 with staples or adhesive or other means. Alternatively, the battens 40 are not fastened to the appliance 20, as preferred, and instead the appliance is merely positioned on the wood runners previously fastened to the tray 30, which is later secured by a transparent film and tensioned strap as discussed below. In another alternative embodiment, the reinforced tray is formed entirely of a relatively rigid material without the battens.

The packaging assembly 10 also comprises a plurality of rigid posts 50 each having a first end portion 52 and an opposing second end portion 54. The rigid posts are preferably fabricated from a relatively low cost, high strength material other than a corrugated paperboard material to support heavier loads characteristic of appliances. In the exemplary embodiment, the rigid posts 50 are angled comer posts having right angle sectional shapes for strength and in some applications to enclose the appliance when assembled with the package 10, as discussed further below.

The posts 50 are preferably a laminated fiberboard material, for example a product known commercially as ANGLEBOARD or another product known commercially as CORNERBOARD, both of which are available from ITW Angleboard, Glenview, Ill. The high strength provided by these preferred products permits sizing or configuring the posts 50 with a relatively low profile to provide maximum product visibility, and at the same time provide a strong package suitable for relatively heavy appliances. The preferred ANGLEBOARD and CORNERBOARD products also have the advantage of being reusable, thereby producing less packaging waste after use.

After the tray 30 is placed below the appliance 20, and in some applications fastened thereto, first end portions 52 of the posts 50 are disposed generally between the side portions 33 of the tray and the appliance 20. In the exemplary embodiment, the angled corner posts 50 are disposed in corresponding corners 32 of the tray 30 between side portions 33 thereof and the appliance 20. The tray 30 is sized relative to the appliance 20 so that the posts 50 are supported at least temporarily in a generally upright position adjacent the appliance without other means until a transparent film is applied thereabout, as discussed further below.

FIG. 1 illustrates padding members 60 preferably disposed between the appliance 20 and posts 50 and on an upper portion 21 of the appliance 20. In some applications, a specified amount of padding between the appliance and packaging assembly is required, for example to comply with industry shipping and packing standards. In other applications, however, the padding members are not necessary, and thus not necessarily a part of the package assembly.

FIG. 1 illustrates some of the padding members formed as right angle-shaped members 62 that are mounted on inner portions of the angled corner posts 50 so that the padding members are disposable toward the appliance 20 about corner portions thereof. The padding members are preferably fastened to the posts, for example with an adhesive prior to assembly of the posts in the tray. FIG. 1 also illustrates some of the padding members configured as recessed padding members 64 similarly mounted to other posts to accommodate a handle 21 or other protruding portions of the appliance 20. FIG. 1 also illustrates strip padding members 63 removably disposable on the upper portion 21 of the appliance 20, for example with tape. The padding members may be, for example, an expanded polystyrene or poly-foam or other shock absorbing material.

Figure 2:
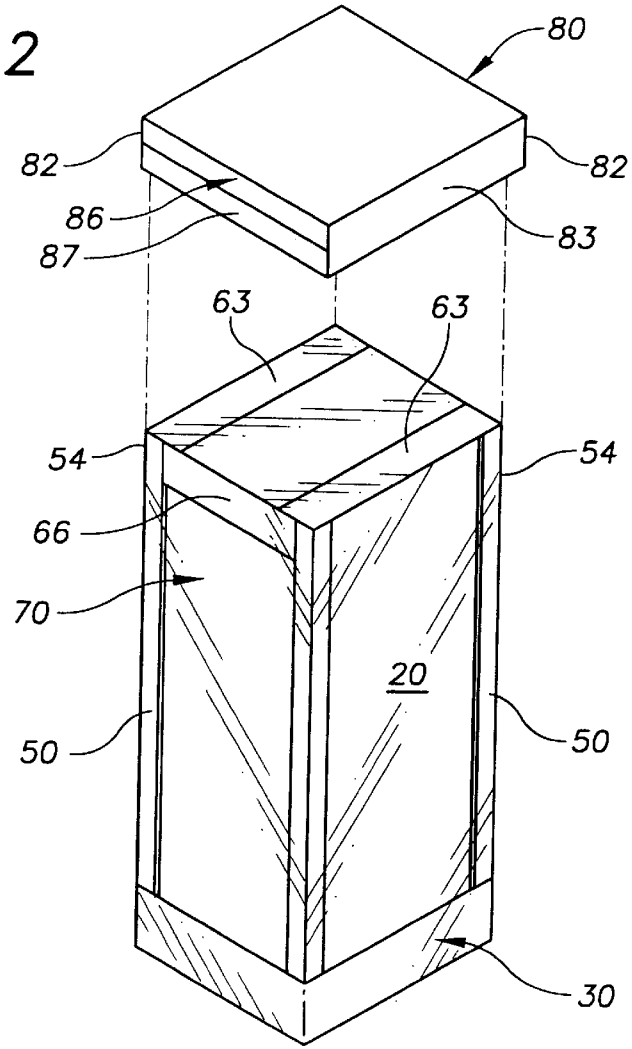
FIG. 2 is more complete partial diagrammatic view of the package assembly according to the exemplary embodiment of the invention.

FIG. 2 illustrates a transparent wrapping or film 70 disposed tightly about at least the posts 50 and the appliance 20 after assembly of the posts 50 in the tray 30 as discussed above and illustrated in FIG. 1. The transparent film 70 is also disposed preferably over the strip padding members 63 on the upper portion 21 of the appliance 20, and about the side portions 33 of the tray 30. The transparent film 70 retains the posts 50 and any padding members 60 fastened thereto firmly about the appliance 20, and retains the tray 30 coupled to the posts 50 if the tray is not fastened directly to the bottom portion of the appliance. The transparent film 70 may also retain the strip padding members 63 on the upper portion of the appliance. The low profile, high strength posts 50 in combination with the tightly wrapped transparent film 70 provide excellent packaging strength and vastly improve product visibility.

The transparent film 70 is preferably a heat shrinkable bag disposed over and covering the upper and side portions of the appliance 20 and posts 50, and preferably over the side portions 33 of the tray 30. The heat shrinkable bag is then shrunk tightly thereabout upon application of heat. Heat shrinkable bags suitable for this purpose are known generally and widely available commercially. The application of the heat shrinkable bag may be performed relatively quickly with minimum labor.

The transparent material 70 may be alternatively a stretch film applied about the posts 50, appliance 20 and preferably the tray 30. Stretch films may be applied manually or by automated machinery, for example with a spiral or other wrapping machine.

FIG. 2 also illustrates the packaging assembly 10 comprising a cover 80 disposable over the appliance 20 and over second end portions 54 of the posts 50. The cover 80 generally has the same shape as the tray 30, and in the exemplary embodiment the cover 80 is rectangular shaped with a plurality of corners 82 defined by corresponding side portions 83 thereof. The cover 80 is formed preferably of the same materials discussed above in connection with the tray 30.

Figure 4A:
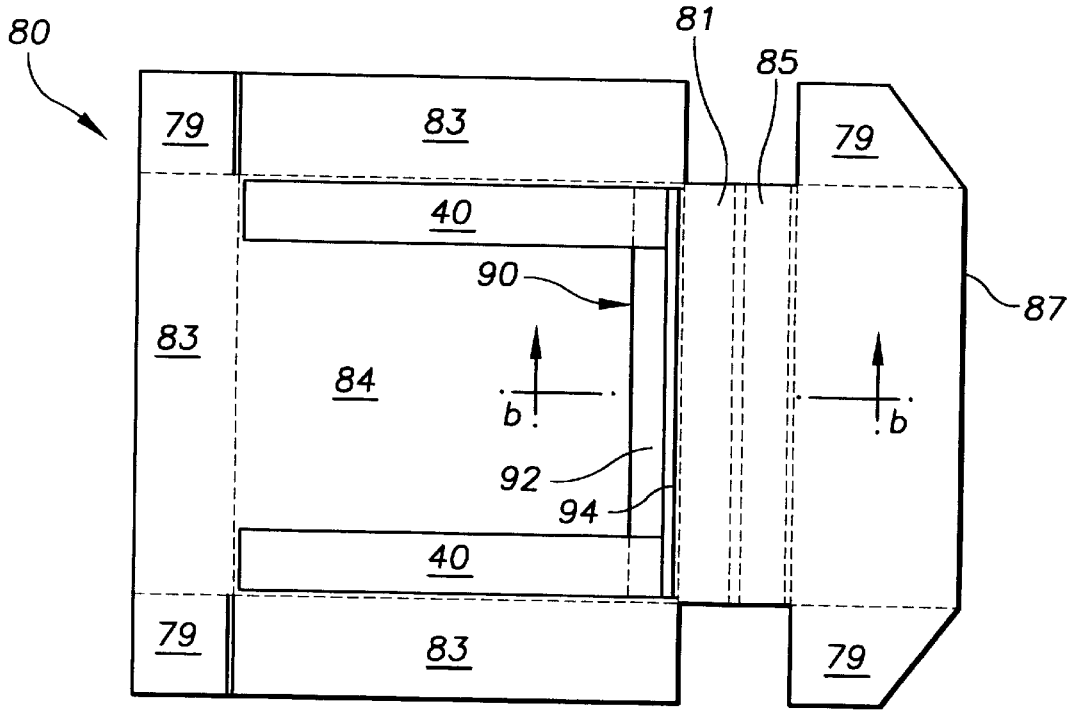
FIG. 4*a* is a partially assembled package.

The cover 80 is also preferably reinforced. In FIG. 4*a*, two battens 40, for example 1×4 wood runners, are disposed on an inner portion of the cover 80 in spaced apart relation so that the battens are located between the appliance 20 and the cover 80, as discussed generally above in connection with the tray 30. The battens 40 are preferably fastened to the cover 80 with staples or adhesive or other means before the cover is placed over the wrapped appliance 20 and posts 50. In another alternative embodiment, the reinforced cover is formed entirely of a relatively rigid material without the battens, also discussed above regarding the tray.

The cover 80 is placed generally over the appliance 20 on the tray 30 after the transparent film 70 has been applied thereabout and about the posts 50 and any padding members 60, as discussed above, so that the second end portion 54 of each wrapped post 50 is disposed between the side portion 83 of the cover 80 and the wrapped appliance 20. In the exemplary embodiment, the corners 82 of the cover 80 are aligned with the corners 32 of the tray 30 when the cover 80 is disposed over the wrapped appliance 20 and posts 50 so that the second end portions 54 of the angled comer posts 50 are disposed in corresponding corners 82 of the cover 80.

Figure 3:
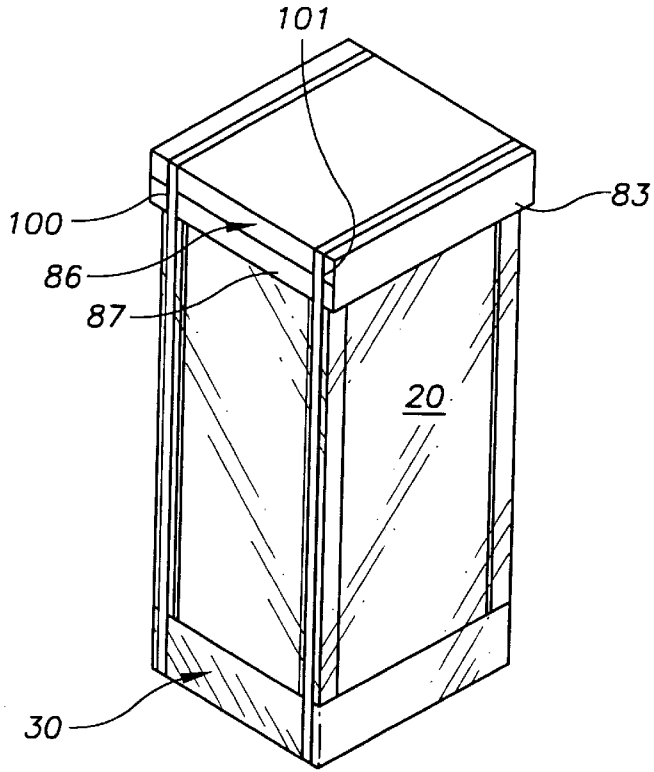
FIG. 3 is perspective view of a complete package assembly according to the exemplary embodiment of the invention.
Figure 4B:
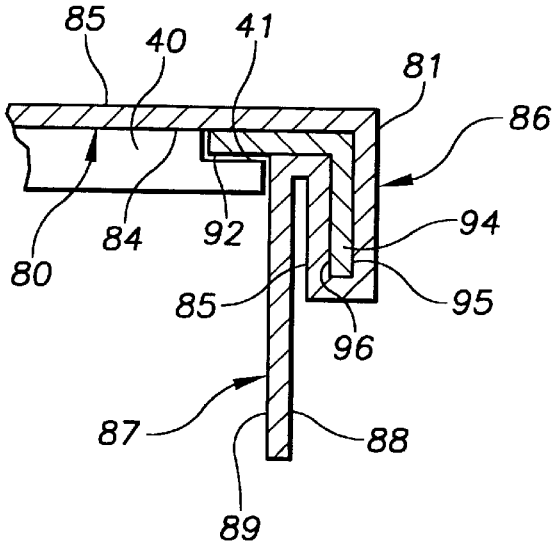
FIG. 4*b* is a partial sectional view along lines b—b of FIG. 4*a* of a fully assembled package.

FIGS. 2, 3 and 4*b* illustrate the cover 80 having a lifting flange member 86 disposed across at least one side thereof. The lifting flange member 86 is engagable by a Basiloid blade to permit lifting and handling of the packaged appliance when the cover 80 is fastened to the package assembly as discussed further below. In other embodiments, the cover 80 may have lifting flange members 86 disposed across more than one side thereof. In the exemplary refrigerator packaging application, the lifting flange member 86 is located preferably on a back side portion of the refrigerator to prevent damage thereto during Basiloid blade lifting and handling. In embodiments where the cover 80 is a corrugated paperboard material, the corrugation direction is preferably arranged transversely to the lifting flange member 86 for strength.

FIGS. 1 and 2 also illustrate a lift padding member 66 located opposite the lifting flange member 86 when the cover 80 is place over the wrapped appliance 20 and posts 50 to further protect the appliance 20 during Basiloid blade lifting and handling. The lift padding member 66 may be taped or otherwise removably fastened to the appliance prior to wrapping the transparent film 70 thereabout. The lift padding member 66 is also preferably made from the same materials as the other padding members 60, as discussed above.

The lifting flange member 86 of the cover is defined preferably by a portion of the cover folded over a portion of a reinforcing member extending from an inner portion of the cover, as illustrated in FIGS. 4*a* and 4*b*. The reinforcing member is preferably fabricated from a relatively low cost, high strength material other than corrugated paperboard to permit Basiloid blade lifting thereof. In the exemplary embodiment, the reinforcing member is an angled corner member 90, formed for example from a laminated fiberboard material, preferably one of the products known commercially as ANGLEBOARD and CORNERBOARD available from ITW Angleboard, Glenview, Ill., as discussed above.

In the exemplary embodiment of FIGS. 4*a* and 4*b*, the cover 80 is formed of a corrugated paperboard or other similarly workable sheet stock. The cover 80 comprises generally a cover portion having an inner and outer portions 84 and 85, and side portions 83 formed by folding portions of the sheet stock and fastening flap portions 79 thereof, as discussed generally above. FIGS. 4*a* and 4*b* also illustrates battens 40 disposed on the inner portion 84 of the cover 80.

The lifting flange member 86 is disposed across an outer portion of a side portion 87 of the cover 80. The lifting flange member 86 includes preferably a first portion 92 of the angled corner member 90 disposed along, and preferably fastened by an adhesive or otherwise to, the inner portion 84 of the cover. A second portion 94 of the angled corner member 90 extends from the inner portion 84 of the cover 80 and is disposed across an outer portion 88 of the cover side portion 87. FIG. 4*b* illustrates a portion of the cover 80 folded over the second portion 94 of the angled corner member 90. A Basiloid blade is disposable between the covered second portion 94 of the angled corner member 90 and the outer portion 88 of the cover side portion 87 to lift the packaged appliance when the cover 80 is secured to the package as discussed further below. In FIG. 4*b*, one of the battens 40 is shown having a recess 41 for accommodating a portion of the angled corner member 90.

In FIG. 4*b*, the portion of the cover 80 folded over the reinforcing member 90 is preferably a continuous member having a first portion 81 extending continuously from the cover 80 along a first side 95 of the second portion 94 of the angled corner member 90, and a second portion 85 extending therefrom continuously back toward the cover 80 along an opposing second side 96 of the second portion 94 of the angled corner member 90. The side portion 87 of the cover 80 also extends preferably continuously from the second portion 85 thereof.

FIG. 3 illustrates strap applied about the tray 30 and cover 80 and over the lifting flange member 86, upon assembly of the package portions illustrated in FIGS. 1 and 2. The strap preferably comprises two separate bands of tensioned strap 100 and 101 each disposed about the tray 30, the cover 50, along opposing posts 50 and over a corresponding portion of the lifting flange member 86. The bands of tensioned strap 100 and 101 are also disposed preferably about reinforced portions of the tray 30 and the cover 80, and in the exemplary embodiment the straps are disposed about outer portions of the tray and cover opposite the corresponding battens 40 disposed therein. Thus configured, the packaging assembly may be lifted and handled upon engagement of the lifting flange member 86 by a Basiloid blade. The packaging assembly may also be lifted and handled by a clamp truck.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A packaging assembly cover, comprising:

a corrugated paperboard cover portion with inner and outer sides: corrugated paperboard side walls portions extending from the cover portion;

a lifting flange member disposed across an outer portion of one of the side wall portions, the lifting flange member having a reinforcing member with first and second portions oriented at an angle relative to each other, the first portion of the reinforcing member disposed on the inner side of the cover portion along the side wall portion across which the lifting flange is disposed, the second portion of the reinforcing member disposed across the side wall portion across which the lifting flange is disposed;

a portion of the cover portion folded over the second portion of the reinforcing member.

2. The cover of claim 1, the portion of the cover portion folded over the second portion of the reinforcing member has a first portion extending continuously from the cover portion along a first outer side of the second portion of the reinforcing member and a second portion extending continuously from the first portion thereof along a second inner side of the second portion of the reinforcing member.

3. The cover of claim 1, corrugations of the corrugated paperboard cover portion aligned transversely to the lifting flange member.

4. The cover of claim 2, the side wall portion across which the lifting flange member is disposed is formed by a third portion of the cover portion extending continuously from the second portion thereof along the second inner side of the second portion of the reinforcing member.

5. The cover of claim 1, the first and second portions of the reinforcing member are connected and are formed of a laminated fiberboard material.

6. The cover of claim 1, further comprising battens disposed across the inner side of the cover portion, end portions of the battens disposed over the first portion of the reinforcing member.

7. An appliance packaging cover comprising:

a cover portion;

a flap extending from the cover portion;

a unitary reinforcing member having a first flange portion and a second flange portion extending therefrom at an angle, the first flange portion disposed on the cover portion and the second flange portion extending from the cover portion along where the flap extends, the flap having a first fold, a first portion of the flap extending from the first fold thereof along an outer side of the second flange portion of the reinforcing member, the flap having a second fold, a second portion of the flap extending from the second fold thereof along an inner side of the second flange portion of the reinforcing member.

8. The cover of claim 7, the flap having a third fold along the second flange portion of the reinforcing member, a third portion of the flap extends from the third fold and forms a cover side wall portion adjacent the second flange portion of the reinforcing member.

9. The cover of clam 7, the cover portion and the flap extending therefrom constitute a unitary corrugated paperboard material.

10. The cover of claim 9, corrugations of the cover portion and flap are transverse to the reinforcing member.

11. The cover of claim 9, the reinforcing member is a right angle member formed of a laminated fiberboard material.

12. The cover of claim 9 further comprising rigid support members disposed in spaced apart relation on the cover portion, end portions of the rigid support members disposed on the second flange portion of the reinforcing member disposed on the cover portion.

13. The cover of claim 7, at least two battens fastened to the cover portion, end portions of the battens have a recess for accommodating a portion of the reinforcing member.

14. A packaging cover for handling by a Basiloid blade, comprising:

a cover member having a first fold extending along a side thereof defining a flap extending therefrom;

a unitary reinforcing member having first and second flange portions disposed at a right angle relative to each other, the first flange portion disposed on the cover member and the second flange portion extending therefrom along the first fold, at least a portion of the second flange portion enclosed by folded portions of the flap.

15. The cover of claim 14, a second fold on the flap spaced apart from and generally parallel to the first fold, a portion of the flap between the first and second folds is disposed on one side of the second flange portion, a third fold on the flap spaced apart from and generally parallel to the second fold, a portion of the flap between the second and third folds is disposed on an opposite side of the second flange portion.

16. The cover of claim 14, the cover portion and the flap extending therefrom comprise corrugations transverse to the reinforcing member.

17. The cover of clam 16, the cover portion and the flap extending therefrom are a corrugated paperboard material.

18. The cover of claim 14, the reinforcing member is a right angle member formed of a laminated fiberboard material.

19. The cover of claim 14, further comprising rigid support members disposed in spaced apart relation on the cover member, end portions of the rigid support members disposed over a portion of the reinforcing member, the end portions of the support member have a recess for accommodating the reinforcing member.

* * * * *